US005551196A

United States Patent [19]

Paredes et al.

[11] Patent Number: 5,551,196

[45] Date of Patent: Sep. 3, 1996

[54] WINDOW ASSEMBLY HAVING DEAD AIR SPACES FORMED BY NON CONDUCTIVE MEMBERS

[75] Inventors: Ivan Paredes, Fremont; Glen A. Barth, Castro Valley, both of Calif.

[73] Assignee: Rylock Company Ltd., Union City, Calif.

[21] Appl. No.: 79,615

[22] Filed: Jun. 17, 1993

[51] Int. Cl.[6] ..... E06B 1/32

[52] U.S. Cl. ..... 52/204.1; 52/204.71; 49/420; 49/DIG. 1; 49/DIG. 2

[58] Field of Search ..... 52/204.1, 399, 52/204.62, 204.67, 204.68, 204.71; 49/DIG. 1, DIG. 2, 420

[56] References Cited

U.S. PATENT DOCUMENTS

| | | | |
|---|---|---|---|
| 2,953,824 | 9/1960 | Minick . | |
| 3,070,856 | 1/1963 | Minick . | |
| 3,106,754 | 10/1963 | Grossman . | |
| 3,302,354 | 2/1967 | Mermell . | |
| 3,325,944 | 6/1967 | Crain . | |
| 3,947,998 | 4/1976 | Matsubara | 49/420 |
| 3,975,881 | 8/1976 | Ninowski, Jr. . | |
| 4,431,225 | 2/1984 | Grise . | |
| 4,437,266 | 3/1984 | Keller . | |
| 4,608,796 | 9/1986 | Shea, Jr. | 52/399 |
| 4,640,078 | 2/1987 | Haffer | 49/DIG. 1 |
| 4,726,147 | 2/1988 | Beske . | |
| 4,903,436 | 2/1990 | Rouillard . | |
| 4,993,204 | 2/1991 | Kuritsky et al. | 49/DIG. 1 |
| 4,999,958 | 3/1991 | Harrison | 52/399 |
| 5,038,537 | 8/1991 | Frambach | 49/DIG. 1 |
| 5,042,199 | 8/1991 | Schneider et al. | 49/DIG. 1 |

FOREIGN PATENT DOCUMENTS

| | | | |
|---|---|---|---|
| 2541354 | 8/1984 | France | 52/204.71 |

*Primary Examiner*—Carl D. Friedman
*Assistant Examiner*—Christopher Todd Kent
*Attorney, Agent, or Firm*—Loeb & Loeb

[57] ABSTRACT

A window assembly having improvements for thermal efficiency is described. Dead air spaces are created in and around the frame of the window assembly through the addition of nonconductive members. The nonconductive members, and the dead air spaces thereby created, reduce thermal conduction by the frame and improve thermal efficiency of the window. The nonconductive members may be adapted to cover air pockets within the frame, such as between opposing support legs. Other nonconductive members may be adapted to cap exposed portions of the frame. Other nonconductive members may be adapted to hold a panel against the frame.

10 Claims, 3 Drawing Sheets

WINDOW ASSEMBLY HAVING DEAD AIR SPACES FORMED BY NON CONDUCTIVE MEMBERS

FIELD OF THE INVENTION

The present invention relates generally to window assemblies, and in particular devices and methods for improving the thermal efficiency of such windows. As used herein, the term "window assembly" includes sliding and fixed windows located at typical window levels, fixed windows that extend to the floor, and sliding windows that extend to the floor and also function as sliding doors. The present invention is applicable to windows that slide horizontally, windows that slide vertically, and windows that fold out.

DESCRIPTION OF RELATED ART

Window assemblies typically comprise at least one panel, such as a clear sheet of glass, and a frame into which the panel is mounted. The frame is typically mounted into a wall of a building or other structure. Such window assemblies have also been installed in vehicles, as shown in a patent to Grise, U.S. Pat. No. 4,321,228, issued Feb. 14, 1984.

It is well known in the art to preassemble frames so that they may be carried to a job site and installed as a unit. Such frames generally include a number of members which are joined together in such a fashion so as to produce a substantially permanent and stable assembly. The frame members are commonly made from extruded aluminum. Vinyl or plastic caps are sometimes secured to exposed portions of aluminum frames. These caps typically are fitted close to the frame, creating an air space of less than a ⅛" gap or are contacting the frame.

Aluminum members have been used in frames for several well known reasons. First, aluminum, unlike many other materials, may be extruded into the complex shapes of members. Second, once formed, the aluminum members are typically quite rigid. Third, aluminum members are generally resistant to the elements and require relatively little maintenance. Fourth, aluminum is generally relatively inexpensive. Fifth, the aluminum members are relatively lightweight, so shipping costs are minimized. Sixth, aluminum members may be manufactured with a variety of low cost finishes. In sum, aluminum members provide long term performance at a low cost in aesthetically pleasing designs.

Frames typically include channels into which a panel may be installed. In the case of a rectangular panel, the channels will form a rectangle into which the panel may be installed. Where only a single window panel will be installed, only a single channel in each side of the frame is necessary. Also, if more than one panel is to be installed, but all panels will be non-movable, then there is only needed a single channel in each side of the frame which is long enough to accommodate all of the panels. Sliding panels necessitate extra channels in the frame, so that a sliding panel may move parallel to an adjacent panel.

The window channels are defined by side legs mounted to the base of a window frame member in a wall around the perimeter of the window. Typically, the adjacent panel also is a window panel. The window pane of a sliding window usually is encased in a sash that slides in the channels. Typically, rollers are attached to the bottom of the sash to facilitate easy movement of the sash in the channels.

The thermal efficiency, or "U" value of windows has become of increasing importance. The U value is a measure of heat conductivity of the window between the inside and the outside of a structure in which the window is mounted. The lower the U value, the more thermally efficient the window assembly. Thermal efficiency has become more important primarily because of increased costs of heating and cooling, and concerns about environmental damage that may occur from generation of power necessary for heating and cooling. Governmental agencies in many regions have established minimum thermal efficiencies for window assemblies. As concerns about energy usage and environmental impact have increased, maximum permissible U values have decreased.

The well known methods for improving thermal efficiency of window assemblies include the use of multiple paned panels. A typical panel comprises two glass panes held separate by a spacer between the panes along their edge—a double paned window. Spacers typically are made of aluminum.

Double paned panels improve thermal efficiency in at least two ways. First, because glass has some insulating properties, the second pane of glass alone improves thermal efficiency. Second, the region between the two panes of glass comprises a dead air space which also acts as a thermal barrier.

In general, the primary focus of improvements of thermal efficiency have been the panels. Improvements to panel designs have resulted in improved thermal efficiency of window assemblies. Multiple paned panels, i.e. double and triple paned, have lower U values than window assemblies using single paned panels. However, multiple paned windows cannot economically meet increasingly strict regulation of U values. Problems include increased cost of materials, manufacturing, shipping, and maintenance.

Other designs have been directed to adding an insulating material to the frames. One design has been called the "poured and de-bridged" design. In the poured and de-bridged design, the aluminum frame members are extruded with a specially shaped cavity. Heated polyurethane or a similar material is poured into the cavity. After the material has cooled and solidified into an insulator, a section of the cavity is cut away and the aluminum member is separated into two parts connected by the insulator. The insulator provides a "thermal break".

Such thermal break designs increase cost of manufacture, increase materials cost and increase weight and therefore shipping costs. Furthermore, the insulator is subject to shrinkage in the cross-sectional and longitudinal direction. If the insulator shrinks in the cross-sectional direction, the aluminum parts may be free to move, thereby causing changes in dimensional relationships between various points in the frame. If the insulator shrinks in the longitudinal direction, a space may be created at the ends of the member. When separate members are joined to form a frame, these spaces form gaps which allow leakage through the frame.

Other thermal break designs are produced by using two extruded aluminum members having keyways. Fitted into the keyways to thereby join the members is polyvinyl chloride (PVC) or other nonconductive material. Such thermal break designs share many of the problems already described. In particular, the manufacturing process of forming the keyways and fitting the insulator into the keyways can be quite complex and therefore time consuming and error-prone. Maintaining necessary tolerances has been found to be particularly difficult.

In addition, thermal break designs generally reduce design flexibility since the thermal breaks require substantial space and cannot have the irregular shapes of aluminum members.

Wood windows have also been used for hundreds of years. However, wood windows have the disadvantages of: (1) high cost, (2) diminishing resources, (3) high maintenance requirements and cost, (4) poor resistance to air infiltration, and (5) difficulty in operation.

Therefore, it is one object to improve the thermal efficiency of window assemblies. It is another object to improve the thermal efficiency of window assemblies without change to the shape or design of existing window assemblies. It is another object to provide a low cost method of improving thermal efficiency of window assemblies. It is another object to retain the advantages of using aluminum frame members while improving the thermal efficiency of window assemblies. These objects and others are provided in the window assembly of the present invention.

SUMMARY OF THE INVENTION

The invention is directed to aluminum framed window assemblies having improvements for thermal efficiency. The inventors have discovered that a large problem with aluminum framed windows is that the aluminum frames act as heat conductors and greatly reduce thermal efficiency. According to the invention, dead air spaces are incorporated into the frame and between the frame and the panel. These dead air spaces greatly enhance the thermal efficiency of the window assembly by insulating the frame.

According to one aspect of the invention, L-shaped and U-shaped spaces defined by frame members are sealed with covers. The cover and the frame member define a dead air space. The efficiency of the dead air space is further enhanced by forming the cover from PVC or other insulating material.

According to a second aspect of the invention, parts of the frame which might otherwise be exposed to inside air or outside air are capped with a cap. The cap may simply be clipped onto the exposed surface of existing frame members. By forming the caps in a U shape, once installed, the cap and the frame define a dead air space. The cap may be formed of PVC or other rigid insulating material. Thus, like the cover, the cap provides a dead air space and an insulator between the inside air or outside air and the frame.

According to a third aspect of the invention, a glazing bead having a U-shaped section is used for holding a panel into a frame. The glazing bead defines a dead air space between the frame and the edge of the panel. By forming the glazing bead of PVC or like material, the glazing bead provides additional insulation in a manner similar to the cover and the cap.

Thus, it will be seen that the present invention provides the highly desirable result of increased thermal efficiency, while overcoming the problems of the window assemblies described above. The cover, cap and glazing bead are inexpensive light weight, easily installed and easily replaced. Existing frame designs may be readily adapted without substantial change to take advantage of the invention.

DESCRIPTION OF THE DRAWINGS

These and other advantages of the present invention are best understood with reference to the drawings, in which.

DETAILED DESCRIPTION OF THE PREFERRED EMBODIMENT

A window assembly according to the invention is described. Throughout this description, the preferred embodiment and examples shown should be considered as exemplars, rather than limitations on the method and apparatus of the present invention.

Figure 1:
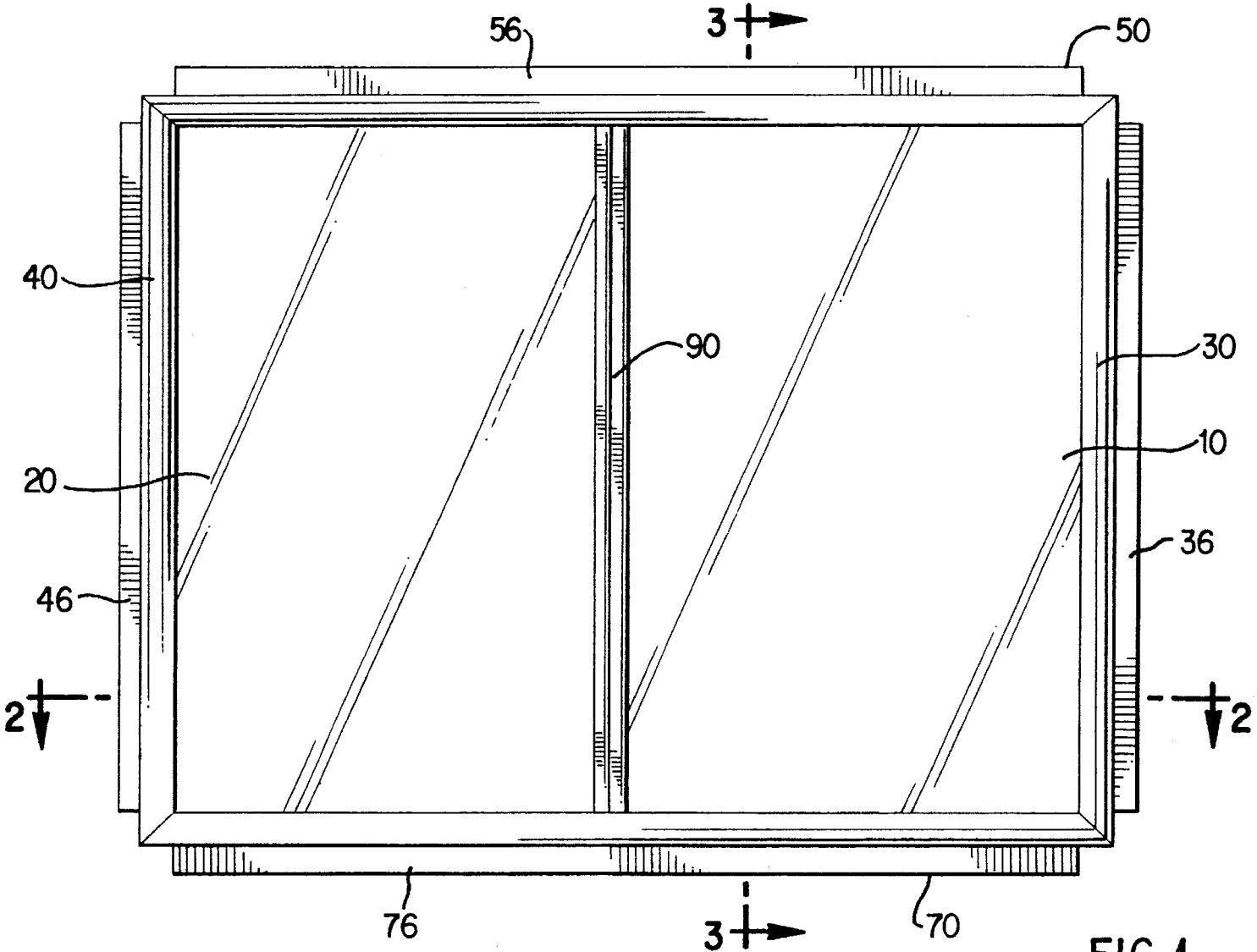
FIG. 1 schematic side view of a window assembly.

Referring now to FIG. 1, there is shown a window assembly having two double-paned panels. The window assembly comprises a sliding panel 20, a fixed panel 10, and a frame. The frame comprises a head 50, a sill 70, a right jamb 30, a left jamb 40, and a fixing bar 90. The fixing bar 90 is attached to the head 50 and the sill 70. The head 50, the sill 70, the left jamb 40 and the right jamb 30 are secured to a supporting structure (not shown) such as a wall of a building. The head 50, the sill 70 and the jambs 30, 40 include nailing fins 56, 76, 36, 46 which are used for securing the frame to the supporting structure. In some installations, for example on masonry walls, the nailing fins 36, 46, 56, 76, are undesirable and may be removed at the factory. Since a building typically has an inside and an outside, the following description will be with reference to such an inside and outside.

The fixed panel 10 is fixed in channels in the head 50, the sill 70, the fixing bar 90 and the right jamb member 30, as known in the art. The sliding panel 20 is positioned on the inside of the window assembly, and thus slightly behind the fixed panel 10. The sliding panel 20 slides from the left jamb 40 within the head 50 and the sill 70 past the fixing bar 90 in channels in the head 50 and the sill 70 so that the window may be opened, as known in the art.

Figure 2:
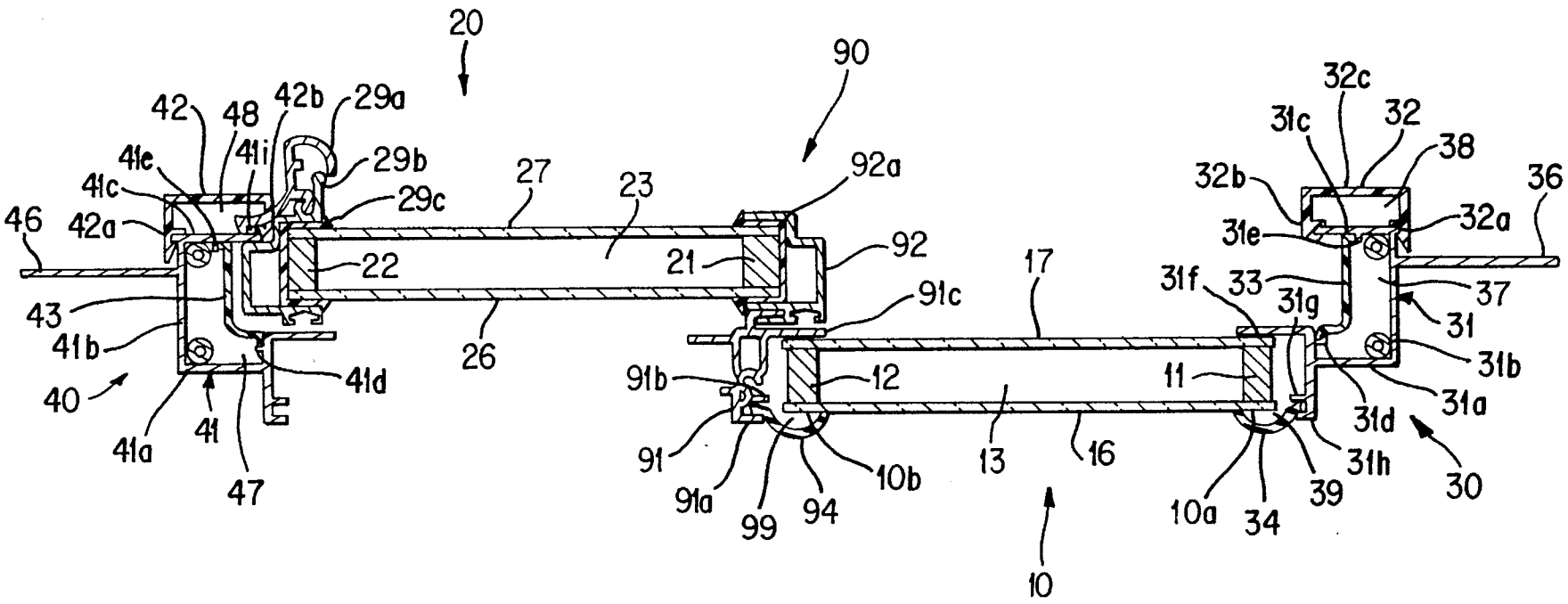
FIG. 2 is a horizontal sectional view of the window assembly of FIG. 1.

Referring now to FIG. 2 there is shown a top sectional view of the window assembly of FIG. 1 taken along reference line 2—2. The fixed panel 10 comprises a glass outer pane 16, a glass inner pane 17, a right spacer 11 and a left spacer 12. The panes 16, 17 and spacers 11, 12 define a dead air space 13 in the fixed panel 10. The spacers 11, 12 may be made of any of the materials as known in the art, such as aluminum. The panel assembly is sealed around its perimeter with one or more sealants as known in the art. The fixed panel 10 has a right edge **10*a* and a left edge 10*b***.

The sliding panel 20 comprises a glass outer pane 26, a glass inner pane 27, and spacers 21, 22, defining a dead air space 23. The sliding panel 20 also includes a sash lock stile **29*b* and a sash interlock stile 92 which make up the vertical members of the panel's sash. The sash lock stile 29*b* and sash interlock stile 92 are preferably made of extruded aluminum. The panes 26, 27 and spacers 21, 22 of the sliding panel 20 are held fixed in the sash lock stile 29*b* and sash interlock stile 92 by U-strips 29*c* and 92*a*, respectively. The U-strips 29*c* and 92*a* have a U-shaped cross-section. The U-strips 29*c*, 92*a* preferably are made of a durable, compressible material, such as flexible vinyl. During manufacturing, the spacers 21, 22 may be placed between the two panes 26, 27** at each of their edges, and sealed around the entire perimeter of each pane using one or more sealants suitable for this purpose, and a U-strip placed over each edge of the pane. The U-strips may then be pressed into corresponding sash members.

The right jamb 30 comprises a right jamb member 31, a right glazing bead 34, a right jamb cover 33 and a right jamb cap 32. The right jamb member 31, preferably aluminum, comprises an outside leg 31*a*, a connecting web 31*b* and an inside leg 31*c*. The outside leg 31*a*, the connecting web 31*b*, and the inside leg 31*c* form a U shape. When the sliding panel 20 is moved to the right to a fully opened position, the sash interlock stile 92 moves into and stops at the right jamb member 31.

The right jamb member 31 defines an outside leg 31*a* having an L-shaped portion 31*f* and retaining posts 31*g* and 31*h* on the L-shaped portion 31*f*. A retaining clip 31*d* is on the inside of the outside leg 31*a*. The outside face of the inside leg 31*c* includes a retaining clip 31*e*. The right jamb cover 33 is preferably made of a physically resilient, weather resistant, nonconductive material such as PVC. The right jamb cover 33 is fixed in the retaining clips 31*d* and 31*e* of the right jamb member 31, and may held in place by pressure by selecting the right jamb cover 33 to be slightly larger than the distance between the retaining clips 31*d*, 31*e*. The right jamb cover 33, the outside leg 31*a*, the connecting web 31*b* and the inside leg 31*c* define a dead air space 37.

The right jamb cap 32 may be of a similar material as the right jamb cover 33. The right jamb cap 32 may be snapped on the inside leg 31*e* of the right jamb member 31. The right jamb cap 32 is substantially U-shaped having a base 32*c* and defines clips 32*a*, 32*b* so that when the right jamb cap 32 is secured by a force fit to the inside leg 31*c* of the jamb member 31, they define a dead air space 38. The dead air space 38 is preferably about 7/16", as measured from the inside leg 31*c* of the jamb member 31 to the base 32*c* of the jamb cap 32. The dead air space must be greater than 1/8" to be effective, and preferably at least 1/4".

The right glazing bead 34, preferably of a material similar to the right jamb cover 33, is wedged between the right edge 10*a* of the outer pane 16 and the retaining posts 31*g* and 31*h*. The fixed panel 10, the right glazing bead 34 and the outside leg 31*a* of the right jamb member 31 define a dead air space 39. The glazing bead 34 is adapted to engage a retaining clip 31*g*.

The fixing bar 90 comprises a fixing bar member 91 and a glazing bead 94. The fixing bar member 91, preferably of extruded aluminum, includes an inside leg 91*c* and retaining posts 91*a* and 91*b*. The glazing bead 94, preferably of the same material as the right glazing bead 34, is wedged between the outer pane 16 of the fixed panel 10 and the retaining posts 91*a* and 91*b* and is held in place by pressure. The fixed panel 10, the glazing bead 94 and the fixing bar member 91 define a dead air space 99.

The inside leg 91*c* of the fixing bar 91, and the glazing bead 94 secure the left edge 10*b* of the panel 10; the L-shaped portion 31*f* of the right jamb 31 and the right glazing bead 34 secure the right edge 10*a* of the fixed panel 10.

The materials and structure of the left jamb 40, the head 50 and the sill 70 are substantially the same as those of the right jamb 30 and fixing bar 90. Members are preferably of extruded aluminum, and the covers, the caps and the glazing beads are preferably of a physically resilient, weather resistant, nonconductive material such as PVC. The particular parts of the left jamb 40, the head 50 and the sill 70, their shapes, and arrangement is discussed in detail below.

The left jamb 40 of the window assembly includes a left jamb member 41, a left jamb cover 43, and a left jamb cap 42. The left jamb member 41 includes retaining clips 41*d* and 41*e*, which secure the left jamb cover 43. The left jamb cap 42 is secured by two clips 42*a*, 42*b* to the inside leg 41*c* of the left jamb member 41.

The left jamb member 41 may be identical to the right jamb member 31, the left jamb cover 43 may be identical to the right jamb cover 33, and the left jamb cap 42 may be identical to the right jamb cap 32. Such economies may be achieved by use of standard parts throughout the window assembly.

The sliding panel 20 preferably includes a conventional lock 29*a* which engages a lip 41*i* on the inside leg 41*c* of the left jamb member 41. The lock 29*a* secures the sliding panel 20 to the left jamb member 41. If the lock 29*a* is released, the sliding panel 20 may be moved in the side-long direction toward the right jamb 30.

Figure 3:
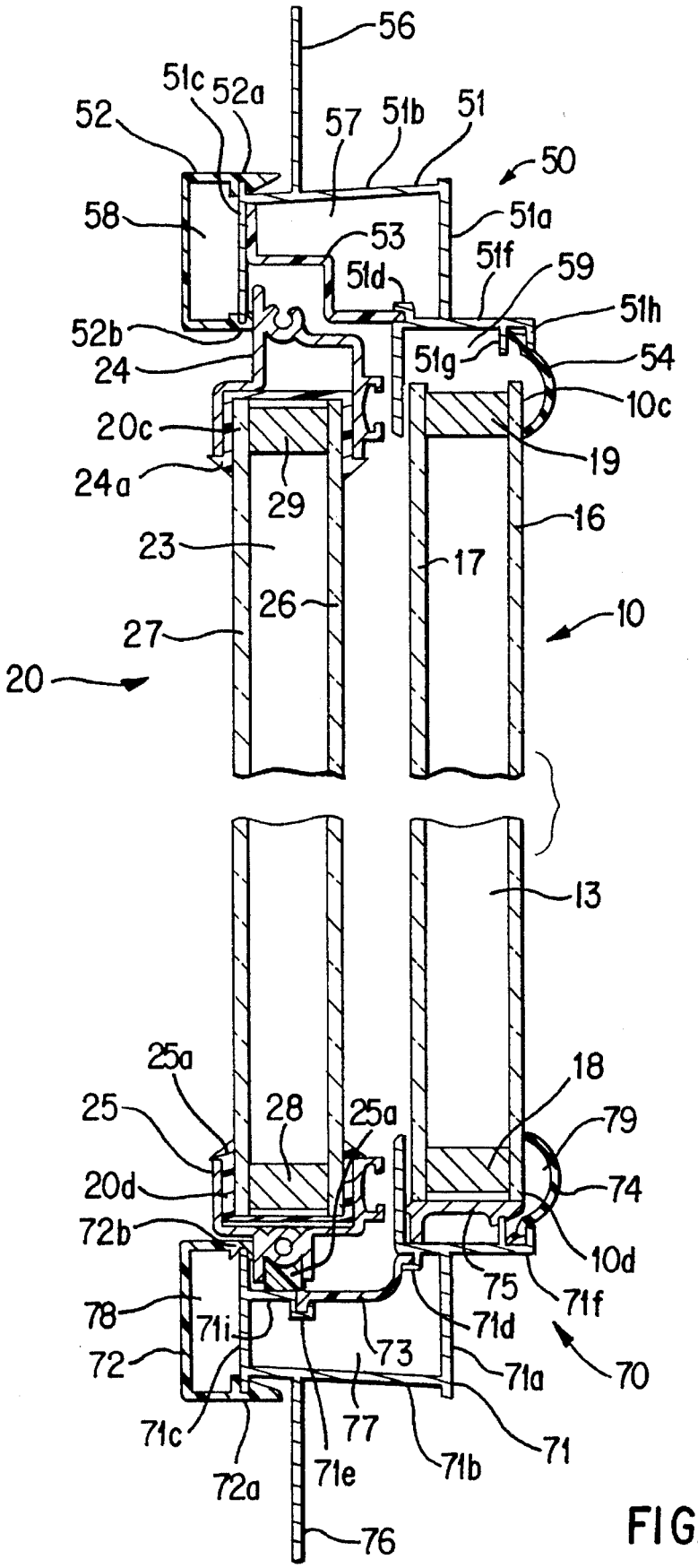
FIG. 3 is a vertical sectional of the window assembly of FIG. 1.

Referring now to FIG. 3, there is shown a vertical cross section of the window assembly of FIG. 1 along reference line 3—3. In this view, there are shown the fixed panel 10, the sliding panel 20, the frame head 50 and the frame sill 70.

The fixed and sliding panels 10, 20 have spacers 18, 19, 28, 29 at their respective top and bottom edges 10*c*, 10*d*, 20*c*, 20*d*. The top spacers 18, 28 and bottom spacers 19, 29 serve the same function as the right and left spacers, 11, 12, 21, 22 discussed above. The sliding panel 20 has a sash head 24 and a sash sill 25. The sash sill preferably has wheels 25*a* riding on a wheel support 71*i* to reduce friction during sliding of the sliding panel 20. The sliding panel also includes U-strips 24*a*, 25*a* at the upper end 20*c* and lower end 20*d*, respectively. The sash head 24 and sash sill 25 are joined to the sash interlock stile 92 and sash lock stile 92*b* respectively to form a sash around the sliding window 20.

The head 50 includes a head member 51, a head cap 52, a head cover 53, and a head glazing bead 54. The head member 51 corresponds substantially with the jamb members 31, 41, and comprises an outside leg 51*a*, a connecting web 51*b* and an inside leg 51*c*. The outside leg 51*a*, the connecting web 51*b*, and the inside leg 51*c* form a U shape. The outside leg 51*a* of the head member 51 has an L-shaped portion 51*f* and retaining posts 51*g* and 51*h* on the L-shaped portion 51*f* to hold the head glazing bead 54. A retaining clip 51*d* is on the inner side of the outside leg 31*a*. The head cover 53 is fixed in a retaining clip 51*d* and wedged against the outer side of the inside leg 51. Thus, the head cover 53, outside leg 11*a*, connecting web 51*b* and inside leg 51*c* define a dead air space 57.

The head cap 52 may be snapped on the inside leg 51*c* of the head member 51 with clips 52*a*, 52*b*. The head cap 52 is substantially U-shaped so that when the head cap 52 is secured to the inside leg 51*c* of the head member 51 by the clips 52*a*, 52*b*, they define a dead air space 58.

The head glazing bead 54 is wedged between the top edge 10*c* of the outer pane 16 and the retaining posts 51*f* and 51*h*. The fixed panel 10, the head glazing bead 54 and the outside leg 51*a* of th head member 51 define a dead air space 59.

The sill 70 has similar construction as the head 50 (and jambs 30, 40), and includes a sill member 71, a sill cap 72, a sill cover 73 and a sill glazing bead 74. The sill member 71 includes an outside leg 71*a*, a connecting web 71*b* and an inside leg 71*c*. Like the head member 51, the sill member 71 differs from the jamb members 31, 41 in the design of the inside leg 71*c*. The inside leg 71*c* of the sill member 71 includes the wheel support 71*i* which includes a retaining clip 71*e*. The wheels 25*a* on the panel 20 slide along the wheel support 71*i*.

The outside leg 71*a* of the sill member 71 also includes an L-shaped portion 71*f* having a retaining clip 71*d*. The sill cover 73 clips into the retaining clips 71*d*, 71*e*. A panel support 75 is positioned within the L-shaped portion 71*f* and supports the fixed panel 10.

The sill glazing bead 74, the bottom edge 10*d* of the fixed panel 10, and the L-shaped portion 71*f* of the outside leg 71*a* of the sill member 71 define a dead air space 79. Another dead air space 77 is defined by the sill cover 73, the outside leg 71*a*, the connecting web 71*b*, and the inside leg 71*c*. Another dead air space 78 is defined by the sill cap 72 and the inside leg 71*c* of the sill member 71.

As explained, dead air spaces are defined in part by the caps 32, 42, 52, 72 —dead air spaces 38, 48, 58, 78. These dead air spaces 38, 48, 58, 78 are preferably sealed from one another, but air may circulate between these dead air spaces without substantially detracting from the performance of the individual dead air spaces.

Also as explained, dead air spaces are defined in part by the covers 33, 43, 53, 73 —dead air spaces 37, 47, 57, 77. These dead air spaces 37, 47, 57, 77 are preferably sealed from one another, but air may circulate between these dead air spaces without substantially detracting from the performance of the individual dead air spaces.

Also as explained, dead air spaces are defined in part by the glazing beads 34, 54, 74 —dead air spaces 39, 59, 79, 99. These dead air spaces 39, 59, 79, 99 are preferably sealed from one another, but air may circulate between these dead air spaces without substantially detracting from the performance of the individual dead air spaces.

Construction, assembly and installation of such a window assembly may be accomplished in an efficient and economical manner. The frame members 31, 41, 51, 71, and 91, may be manufactured as known in the art. The caps, the covers and the glazing beads may be formed using known methods. After the various component parts have been manufactured, the panels and the frame may be put together. In particular, the frame members are joined in the form of the frame as a frame subassembly. The caps and covers may be installed later, for example at a job site, because they are not critical for structural integrity. However, the covers and caps may provide added structural stability to the frame. The panels 10, 20 are assembled as known in the art. Next, the panels 10, 20 are fitted into the frame subassembly. Depending on the climate zone, some or all of the caps and the covers are installed to create dead air spaces as described above.

In milder climate zones, the covers 33, 43, 53, 73 may be installed in the frame subassembly, in the jambs 30, 40, the head 50 and the sill 70, in the manner described above. The covers may simply be snapped into the clips of the frame members, without the need for special tools. Preferably, the covers have sufficient flexibility to be snapped into the clips and held by friction and pressure. The covers prevent air from the inside from directly contacting any part of the aluminum frame members which are exposed to the outside. Thus, where the outside is cold, below 50° F. and the inside is heated, the covers reduce heat exchange through the frame members from the inside to the outside. Conversely, the covers and the dead air spaces created by the covers reduce cooled inside air from being warmed by warmer outside air.

In more severe climate zones, the caps 32, 42, 52, 72 may be installed. Since aluminum is a good heat conductor, parts such as the inside legs 31*b*, 41*b*, 51*b*, 71*b* may conduct heat from inside air to other parts of the aluminum member and thus to the outside. The caps may be clipped onto the exposed inside legs at the job site or at the factory without the need for special tools. The caps preferably have sufficient flexibility to be clipped onto the legs and held in place in a force fit. The caps and the dead air spaces defined by the caps prevent warm inside air from contacting the exposed aluminum frame members to further insulate the frame.

The glazing beads 34, 94, 54, 74, as described, while acting as panel retainers, provide substantial thermal insulation. The glazing beads themselves act to insulate between the panels and the frame members, and also define dead air spaces which help the overall thermal performance of the window assembly.

As can be seen from the drawings, the precise shapes of the covers, the caps and the glazing beads are the result of a design by which these parts may be readily assembled with the aluminum frame members and allow the moving parts of the window assembly (e.g. the sliding panel 20 and lock 29*a*) to function.

Tests have shown that use of the covers, the caps and the glazing beads as described achieves significant improvements in U values. In one embodiment, the U value of a window without the covers or the caps according to the invention was lowered from 0.75 to 0.65 by addition of such parts. U values as low as 0.49 have been achieved in otherwise standard window assemblies by addition of covers, caps, glazing beads and low emissivity glass according to the invention.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

It is claimed:

1. A frame structure for a window assembly having an improved thermal efficiency and including at least one window panel having a periphery, the window assembly having an inside adapted to face an inside environment and an outside adapted to face an outside environment, the frame structure comprising:

a frame member made of a material having a high thermal conductivity, the frame member comprising an inside leg adapted to face the inside environment, an outside leg adapted to face the outside environment, and a web connecting the inside and outside legs, the inside leg, outside leg and connecting web defining a U-shape adapted to receive a portion of the periphery of said at least one window panel;

a cover made of a material having a low thermal conductivity, said cover connecting the inside and outside legs of the frame member; and a first dead air space defined by the cover, the connecting web and the inside and outside legs of the frame member.

2. A frame structure, as defined in claim 1, including:

a cap made of a material having a low thermal conductivity, said cap being attached to the inside leg of the frame member and adapted to face the inside environment, the cap covering said inside leg; and a second dead air space defined by the cap and inside leg, the second dead air space being thereby adapted to be interposed between the inside leg of the frame member and the inside environment.

3. A frame structure, as defined in claim 2, in which:

the frame member is made of metal, and the cover and cap are made of a thermoplastic.

4. A frame structure, as defined in claim 2, in which:

the cap has a generally U-shaped configuration including a base disposed substantially parallel with the inside leg; and the second dead air space has a dimension of at least about ¼-inch separating said inside leg and the base of said cap.

5. A frame structure, as defined in claim 4, in which:

the cap includes clips engaging the inside leg and attaching the cap to the inside leg, the clips being formed integrally with the cap.

6. A frame structure, as defined in claim 1, including:

means for retaining the cover, the retaining means being formed integrally with the inside and outside legs of the frame member.

7. A window assembly having an improved thermal efficiency, the assembly including an inside adapted to face an inside environment and an outside adapted to face an outside environment, said window assembly further comprising:

at least one window panel, said window panel having a periphery;

a generally rectangular frame operatively associated with the periphery of the window panel so as to support said panel, the frame comprising a head, a sill parallel with said head, and parallel side jambs, the head, sill and jambs comprising substantially identical, extruded aluminum frame members, each frame member including an inside leg adapted to face the inside environment, an outside leg adapted to face the outside environment, and a web connecting the inside and outside legs, the inside leg, outside leg and connecting web defining a U-shaped area adapted to receive a portion of the periphery of said at least one window panel;

a thermoplastic cover connecting the inside and outside legs of the frame member;

a first dead air space defined by the cover, the connecting web and the inside and outside legs of the frame member;

a thermoplastic cap attached to the inside leg of the frame member for facing the inside environment, the cap covering said inside leg; and a second dead air space defined by the cap and inside leg whereby the second dead air space is interposed between the inside leg of the frame member and the inside environment.

8. A window assembly, as defined in claim 7, in which:

said at least one window panel includes a fixed window panel having peripheral edges; and which further includes:

a fixing bar disposed between said jambs generally parallel therewith, and extending between the head and sill;

means carried by said fixing bar and by the frame member of each of the head, sill and one of the jambs, for supporting a peripheral edge of said fixed window panel;

a glazing bead securing each peripheral edge of the fixed window to an associated supporting means; and a third dead air space defined by each peripheral edge of the fixed window panel and the associated glazing bead and supporting means.

9. A frame structure, as defined in claim 7, in which:

the cap has a generally U-shaped configuration including a base disposed substantially parallel with the inside leg; and the second dead air space has a dimension of at least about ¼-inch separating said inside leg and the base of said cap.

10. A window assembly, as defined in claim 7, including:

means for retaining the cover, the cover retaining means being formed integrally with the inside and outside legs of the frame member; and in which:

the cap includes clips engaging the inside leg and attaching the cap to the inside leg, the clips being formed integrally with the cap.

* * * * *